United States Patent [19]

Gundlach

[11] 3,989,211

[45] Nov. 2, 1976

[54] COLUMN DRAWING TABLE

[75] Inventor: Arnold Gundlach, Wilhelmshaven, Germany

[73] Assignee: Franz Kuhlmann KG, Germany

[22] Filed: Dec. 4, 1975

[21] Appl. No.: 637,645

[30] Foreign Application Priority Data

Dec. 30, 1974 Germany ..... 2461830

[52] U.S. Cl. ..... 248/162; 248/400; 248/410

[51] Int. Cl.[2] ..... F16M 11/00

[58] Field of Search ..... 108/144, 147, 148; 248/399, 400, 158, 161, 162, 404, 410, 411, 412; 297/345, 347

[56] References Cited

UNITED STATES PATENTS

| | | | |
|---|---|---|---|
| 3,286,663 | 11/1966 | Mann et al. | 248/162 X |
| 3,588,023 | 6/1971 | Cohen | 248/410 |
| 3,682,424 | 8/1972 | Strumpell | 248/162 |
| 3,788,587 | 1/1974 | Stemmler | 248/404 X |
| 3,908,944 | 9/1975 | Bjork | 248/162 |
| 3,920,209 | 11/1975 | Komura | 248/162 |

FOREIGN PATENTS OR APPLICATIONS

| | | | |
|---|---|---|---|
| 924,721 | 2/1955 | Germany | 248/161 |
| 1,175,399 | 8/1964 | Germany | 248/162 |
| 17,332 | 7/1913 | United Kingdom | 297/347 |
| 858,375 | 1/1961 | United Kingdom | 248/162 |
| 961,345 | 6/1964 | United Kingdom | 297/345 |

*Primary Examiner*—Lawrence J. Staab
*Attorney, Agent, or Firm*—Weingarten, Maxham & Schurgin

[57] ABSTRACT

A vertically adjustable pedestal drawing table with a weight balance provided by a gas spring coupled between the pedestal column and the pedestal foot. Adjustable rollers maintain the true vertical orientation of the column. A pedal operated locking brake fixes the vertical position of the column and a safety locking brake arrests sudden undesired dropping of the column and table.

8 Claims, 3 Drawing Figures

COLUMN DRAWING TABLE

FIELD OF THE INVENTION

This invention relates generally to pedestal drawing tables, and more particularly concerns a vertically adjustable drawing table with roller guides having a locking brake to maintain vertical position and a safety device to arrest sudden dropping of the table.

DISCUSSION OF THE PRIOR ART

The gas spring in pedestal drawing tables of the type described herein is located between the vertically movable pedestal column and the pedestal or the pedestal foot. It serves to provide balance for the total weight resulting from the pedestal column, the drawing board, and the drawing mechanism. This balance is to be achieved in such a manner that the drawing table remains at its height and can be adjusted with the application of a relatively small force by the user, after the locking brake has been released, usually by way of foot pedal actuation. This requires, on the one hand, that the pressure of the gas spring be exactly matched to the total weight it has to accommodate, that measures are taken to arrest the pedestal column to prevent the column from unintentionally dropping into the pedestal, e.g. during gas spring failure, and that the gas spring be contained in such a manner that it is easily accessible within the pedestal foot or within the column.

In a previously known pedestal drawing table rollers are arranged in the interior of the hollow pedestal to support and guide the column, the brackets of which are adjustable by movable wedge surfaces to compensate for any play which occurs after extended operation caused by the effects of wear and bending moments on the guides. Any adjustment of the roller brackets has generally been difficult to carry out and requires substantial technical outlay because the adjustment wedges in the pedestal interior cannot be reached from the outside, thereby requiring that the drawing board and the pivoting mechanism be taken off prior to such adjustment. The brackets for the guide rollers moving along the plane running surfaces of the column may be swivel brackets that are attached to the walls of the pedestal in such a manner that they can move. Apart from the wedge adjustment, the rollers may also be supported eccentrically which makes it possible to bring the guide rollers close to the column surface. Apart from the substantial outlay required for this kind of support, any adjustment requires the sheet metal housing of the pedestal to be removed which contributes to more expensive pedestal design and maintenance.

A pedestal drawing machine with a so-called drop prevention device is known for the column (German patent specification No. 2,211,946) that prevents any unintentional and undesired dropping of the column loaded by the board and the drawing mechanism when the locking brake is released, and when the pressure in the gas spring has dropped. For this purpose, a horizontally subdivided piece of tubing is located in the foot of the column. The cylinder of the gas spring engages in the upper portion of this piece of tubing, and a spring is clamped in the lower portion of the tubing, with the spring being supported by the foot. The pedal lever of the locking brake is provided with a lug that can be pivoted into a free space over the piece of tubing only if the gas pressure has the specified magnitude. When the gas pressure of the spring drops, i.e. when the force of the pressure spring clamped in the piece of tubing exceeds the thrust of the gas spring, the piece of tubing is raised against the force of the gas spring so that the lug then contacts the wall of the tube and thus prevents the locking brake from being released. The disadvantage of this safety device is that it is directly coupled with the locking brake and responds only to the gas pressure of the spring but not to the operability of the mechanical elements. In addition, there are problems posed by the insertion and anchoring of the gas spring in the pedestal foot.

SUMMARY OF THE INVENTION

It is the purpose of this invention to provide a pedestal drawing table of the type initially referred to, wherein a smoothly moving height adjustment and safe fixation of the column at the set positions in ensured.

This task in the sense of this invention is accomplished in such a manner that the column guided by the swivel mounted brackets is provided with interior lugs and a releasable horizontal arresting device to accommodate and fix the gas spring. A drop brake with pivoting flap and clamping device is provided for position fixation, this drop brake acting together with stationary clamping surfaces to quickly arrest any unintentional dropping of the column into the pedestal.

Easier assembly and maintenance of the drawing table according to this invention, compared with known designs, especially in regard to the gas spring, is advantageously achieved by horizontal cutouts in the column into which a bracket having the configuration of a bolt can be inserted, the bracket acting together with the upper portion of the cylinder of the gas spring. This upper portion of the cylinder may have a rounded-off lug that engages with a correspondingly shaped cutout of the horizontal bolt thus centering the cylinder.

To ensure secure and simple support of the gas spring in the column, lugs can be provided in the interior of the column that point toward the interior and that, through supporting surfaces, partly surround the cylinder of the gas spring to safely prevent tilting, for example. This support of the gas spring permits simple and fast assembly in those cases where the pressure of the spring has dropped below a predetermined value, and where the gas spring is to be replaced.

If a drawing table has been standing for extended periods of time without any adjustments having been made to the height of the drawing board, the pressure in the gas spring may have dropped significantly so that a release of the locking brake may cause the column and drawing board to tend to sink or drop suddenly into the pedestal. This may pose a hazard to the draftsman and also may cause damage to the sensitive drawing mechanism. Similar detrimental effects also may occur due to breakage of the upper support of the gas spring. To avoid these hazards, the pedestal drawing table of this invention is equipped with a so-called drop brake that consists of a spring-loaded swivel frame that is transversely arranged in the column. Between the struts of the swivel frame there is a flap that is caused to pivot by the compressed air resulting from the sudden dropping motion of the column. The flap actuates a clamping device that engages with the piston of the gas spring or with the walls of the pedestal.

BRIEF DESCRIPTION OF THE DRAWING

The objects, advantages and features of this invention will be more easily appreciated from the following detailed description when read in conjunction with the accompanying drawings, in which.

DETAILED DESCRIPTION OF THE INVENTION

Figure 1:
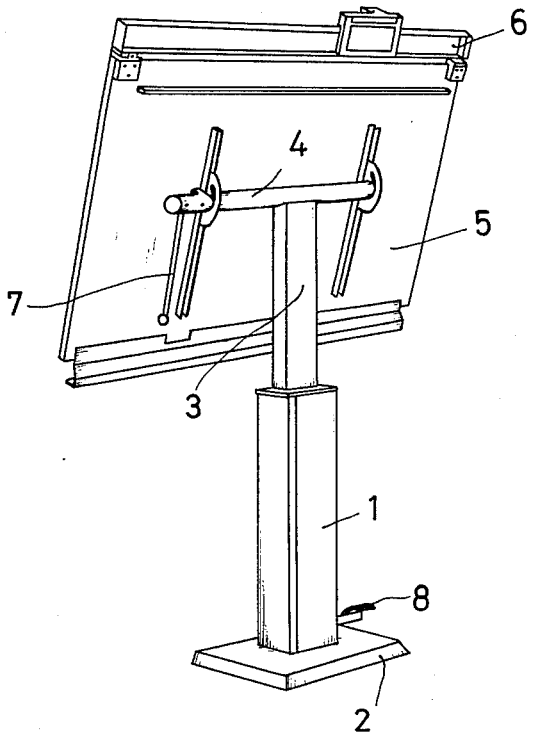
FIG. 1 is a perspective view of the drawing table of this invention.

The pedestal drawing table in FIG. 1 consists of a pedestal 1 in a stable pedestal foot 2 which may, for example, be made of reinforced concrete, a vertically adjustable column 3 in the pedestal, an inclination adjustment 4, and a drawing board 5 with the carriage-type drawing mechanism 6. A lever-actuated clamping brake 7 is used to fix the board at any given inclination, and the vertical position of column 3 is maintained by the locking brake shown in FIG. 2 which is actuated by pedal 8.

Figure 2:
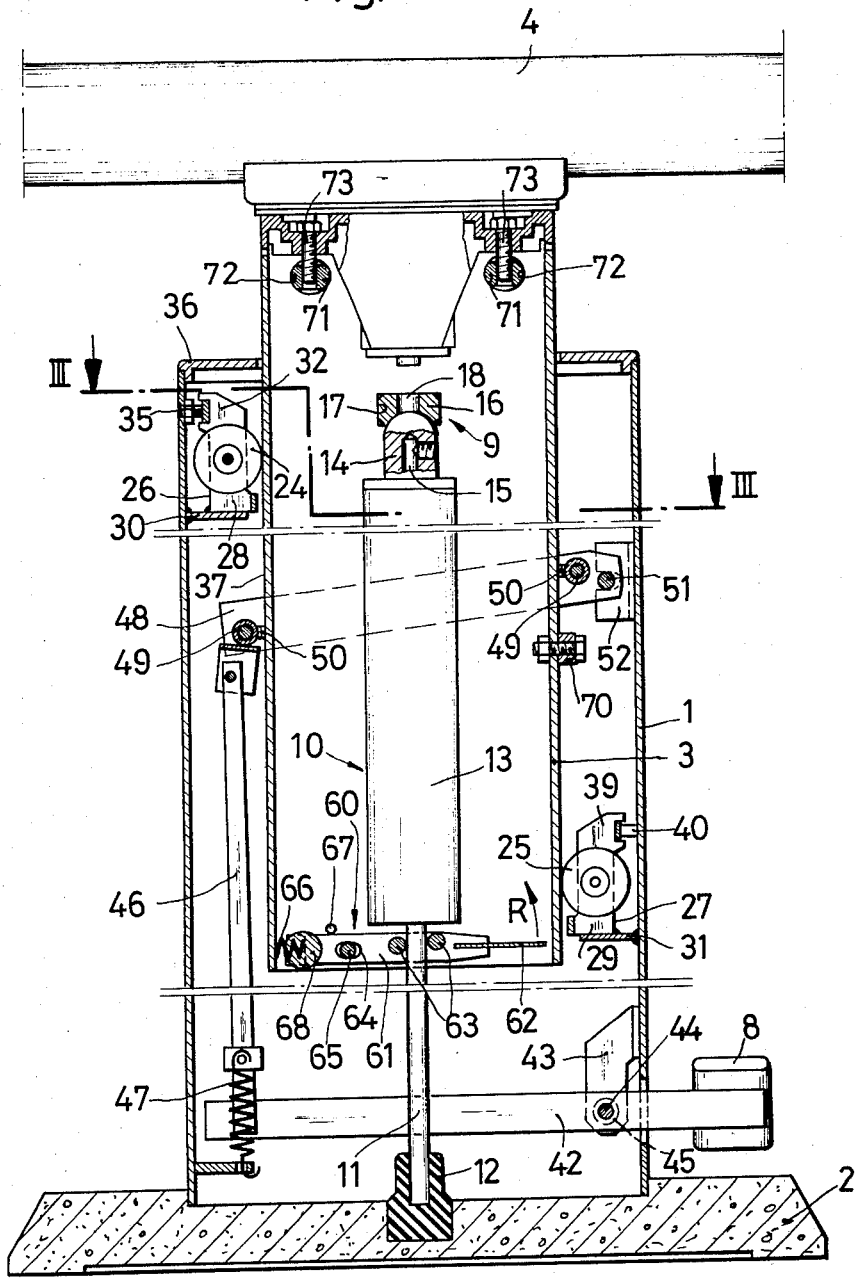
FIG. 2 is an enlarged vertical cross section of the pedestal of FIG. 1 showing the pedestal foot and partly retracted column.

As shown in detail in FIG. 2, a gas spring 10 is clamped between the pedestal foot 2 and a bracket 9 in the column 3. The gas spring piston 11 engages with an impact and sound dampening elastic mounting 12 in the pedestal foot 2. The mounting may be made of rubber or other suitable material. The cylinder 13 of the gas spring 10 is equipped with an upper axial lug 14 that is provided with closable connecting channels 15 for the pressure medium. This axial lug 14 with a ball-shaped head releasably engages a centering recess 18 of a transverse bolt 16 of bracket 9 which is inserted in the recesses 17 in the side walls of the column 3. The recess 18 in transverse bolt 16 is provided to facilitate installation and removal of the gas spring 10.

Figure 3:
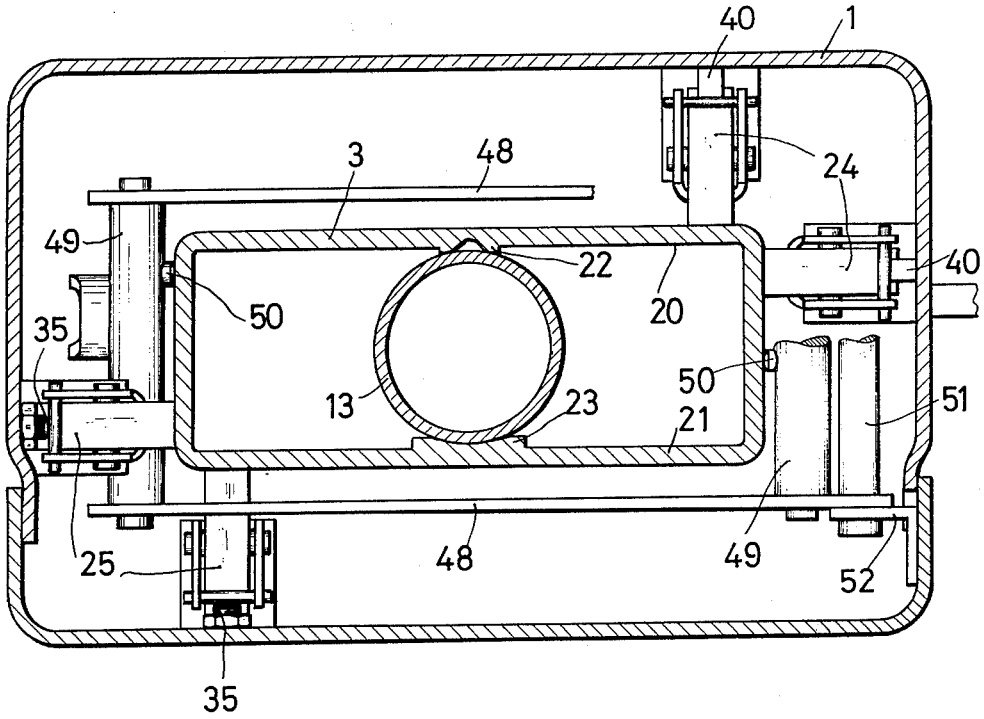
FIG. 3 is a cross section along the line III—III in FIG. 2 of the pedestal and column.

To provide for lateral support of the gas spring 10, the interior surfaces of the column walls 20, 21 (see FIG. 3) are equipped with the profiled lugs 22, 23 that partly surround or cradle the cylinder to prevent it from tilting. These lugs may have the configuration of axial ledges or of short retaining pieces.

To provide for the guiding of the vertically adjustable column 3 in the pedestal 1, guide rollers 24, 25 are provided which act together with the tracks of the column. These rollers are each mounted in a double-arm pair of swivel clamps 26, 27 respectively, in the pedestal 1. One arm 28, 29 of each swivel clamp is mounted to an elastic member 30, 31 respectively, each in the shape of a leaf spring which, for instance, is welded to the interior wall of the pedestal and protrudes into the interior space of the pedestal. The other arm 32 of the swivel clamp 26 rests on an adjusting screw 35 which is accessible to be turned from the outside after removal of an upper pedestal lid 36. This permits the rollers 24 to be adjusted to the corresponding tracks 37 of the column 3. Such adjustment deforms the elastic members 30, 31. The second arm 39 of the swivel clamp 27 rests against a fixed bolt 40 at the wall of the pedestal. The elastic mounting of the rollers 24, 25 results not only in simplified adjustment but also in an extraordinarily gentle and smooth movement of the column because each roller mounting as an entity can elastically yield within certain limits.

The fixation of the drawing board and of the column at a certain height is accomplished by a locking brake which is operated by pedal 8. A double-armed lever 42 carries the pedal 8 and is mounted in pedestal brackets 43 by means of a bolt 44. A bushing 45 of preferably plastic or some other anti-friction bearing material is provided between the bolt 44 and the bracket bearings to facilitate pivotal movement. A rod 46 is hinged to the free end of the lever 42. This rod is biased downward by a tension spring 47 attached to the pedestal foot, as shown in the drawing. The upper end of the rod 46 engages with a rectangular frame that encompasses the column 3. The longitudinal struts 48 (FIG. 3) of the frame are connected by two transverse rods 49 which are provided with clamping pieces 50 that engage to the outer walls of column 3. A lateral rod 51 connected between the free ends of the two struts is hinged in the brackets 52 of the pedestal.

The spring 47 holds the locking brake in the braking position shown in FIG. 2, where the clamping pieces 50 are firmly pressed against the walls of the column under the influence the spring force and the weight of the column, thus preventing any downward vertical movement of the column. By actuation of the brake pedal 8 by pressing it downward, the frame 48 is pivoted around the bearing 51, 52 so that the clamping pieces 50 are disengaged from the column wall, and the drawing board with column can be moved freely up or down.

To prevent any sudden undesired retraction of the column 3 with the locking brake in released position or with the gas spring without pressure or because of gas spring support failure, a so-called drop brake 60 is provided in the interior of the column 3. This device consists essentially of a pivotable frame having longitudinal struts 61, a flap 62 extending between the two longitudinal struts, and clamping members 63 which are located adjacent and adapted to engage the piston 11 of the gas spring. The frame 61 is swivel supported through the longitudinal holes 64 in the struts with a bolt 65 fastened to the column walls. A light spring 66 normally presses the frame 61 against a stop 67. A weight 68 serves to balance the weights of the individual parts of the drop brake 60.

During a sudden dropping of the column 3 into the pedestal 1 the air in the column is compressed by the flap 62 thereby causing frame 61 to pivot around the bearings 64, 65. Because of this swivel motion which is indicated by an arrow in FIG. 2, the two clamping members 63 firmly engage piston rod 11 and thus catch the weight of the column, the drawing table, etc. Any further dropping of the column into the pedestal then is no longer possible.

The gas spring is assembled with the inclination adjustment device 4 removed. The gas spring is introduced into the column in such a manner that the piston 11 engages with the rubber elastic foot 12, and the outer walls of the cylinder 13 rest against the supporting lugs 22, 23 inside the column 3. Subsequently, the bracket 9 is inserted into the column, and the column is let down until the ball-shaped lug 14 of the gas spring cylinder 13 engages in the corresponding centering recess 18 in bolt 16. Further retraction of the column 3 loads the gas spring. A bolt stop 70 is screwed into one wall of the column to limit the maximum extension of the column. The large-surface support of the gas spring cylinder by the supporting lugs 22, 23 and by the gas spring pressure secures the gas spring against tilting and also fixes the bracket 9.

After insertion of the gas spring, the inclination adjustment device 4 is put on the column 3 and screwed on. To accomplish this, threaded couplings 71 are inserted into the borings 72 of the column, and the bolts 73 that penetrate through the inclination adjustment device are screwed into the threaded couplings 71. The column thus is firmly connected with the inclination adjustment device 4.

In view of the above description, deviations from the presented and described device are possible and may occur to those skilled in this art. Instead of the clamping members 63 of the drop brake that engage the piston rod, for instance, other clamping pieces can be inserted that would engage with the interior surfaces of the pedestal walls when the flap 62 is pivoted. Furthermore, an adjustable bracket can be provided not only for the rollers 24 but also for the rollers 25 if desired.

What is claimed is:

1. A vertically adjustable pedestal drawing table comprising:

a pedestal;

a pedestal column;

a pedestal foot secured to said pedestal, said pedestal column being vertically movable with respect to said pedestal foot and said pedestal;

roller means secured to the walls of said pedestal for guiding said pedestal column in vertical movement;

interior lugs vertically arranged on the inside walls of said column;

a gas spring, one end of which is supported by said pedestal, said gas spring effectively providing weight balance for said drawing table and generally comprising a piston and a cylinder;

a releasable transverse bracket mounted to said pedestal column, the other end of said gas spring being positioned and supported by said releasable bracket;

frame means at least partially surrounding said pedestal column and being pivotally connected to said pedestal to releasably hold said pedestal column at any desired position with respect to said pedestal; and a drop brake comprising:

a flap pivotably mounted with respect to said pedestal column; and clamping means coupled to said flap for engaging surfaces which remain stationary with respect to said pedestal to arrest sudden downward movement of said pedestal column with respect to said pedestal and said pedestal foot.

2. The pedestal drawing table according to claim 1 wherein said roller means comprises:

a spring element fastened to the interior wall of said pedestal;

a pair of double-arm swivel clamps, one end of each of which is mounted to said spring element;

a roller rotatably secured to said swivel clamps; and an adjusting screw mounted to the interior wall of said pedestal and engaging the other end of said swivel clamps for transverse adjustment of the position of said roller with respect to said pedestal column wall.

3. The pedestal drawing table according to claim 2 wherein said roller means comprises a plurality of spring elements, swivel clamps and rollers mounted in both the upper and lower portions of said pedestal, at least some of said roller means being adjustable by means of said adjusting screw.

4. The pedestal drawing table according to claim 1 and further comprising sound dampening elastic material in said pedestal foot to which said one end of said gas spring is mounted.

5. The pedestal drawing table according to claim 1 wherein said cylinder of said gas spring is supported by said interior lugs.

6. The pedestal drawing table according to claim 1 wherein:

said other end of said gas spring is formed as a rounded lug;

the interior walls of said pedestal column have recesses therein;

said releasable transverse bolt bracket comprising a transverse bolt having a centering recess shaped to accommodate said rounded lug, the ends of said transverse bolt being mounted in said recesses in said interior walls of said pedestal column.

7. The pedestal drawing table according to claim 1 wherein said drop brake further comprises:

a frame pivotably mounted to said pedestal column;

spring means to maintain said frame in a position so that said clamping means of said drop brake is normally disengaged, said flap being mounted to said frame; and a counterweight mounted to said frame to balance said drop brake;

said clamping means comprising two projections mounted to said frame and positioned on either side of said piston of said gas spring in closely adjacent relationship therewith, said clamping means engaging said piston upon pivoting motion of said frame.

8. The pedestal drawing table according to claim 2 wherein said adjusting screw is accessible from outside said pedestal.

* * * * *